US005226203A

United States Patent [19]

Sacconato et al.

[11] Patent Number: 5,226,203

[45] Date of Patent: Jul. 13, 1993

[54] PROCESS FOR THE CLEANING OF A DRYING CONDENSER IN CLOTHES DRYER

[75] Inventors: Emanuele Sacconato, Venice; Italo Steffanon, Pordenone, both of Italy

[73] Assignee: Zanussi Elettrodomestici S.P.A., Pordenone, Italy

[21] Appl. No.: 825,029

[22] Filed: Jan. 24, 1992

[30] Foreign Application Priority Data

Feb. 6, 1991 [IT] Italy ..... PN91A000007

[51] Int. Cl.[5] ..... D06F 35/00

[52] U.S. Cl. ..... 8/159; 34/42

[58] Field of Search ..... 68/13, 20; 8/158, 159; 34/42, 85

[56] References Cited

U.S. PATENT DOCUMENTS 3,762,866 10/1973 Rayment ..... 8/158
4,187,701 2/1980 Wendel ..... 68/20
4,498,317 2/1985 Thysen et al. ..... 68/20 X
4,903,508 2/1990 Durazzani et al. ..... 68/20
5,115,651 5/1992 Nukaga et al. ..... 68/20 X

FOREIGN PATENT DOCUMENTS 78221 12/1970 Fed. Rep. of Germany ..... 68/20
1-223997 9/1989 Japan ..... 68/20
2-174897 7/1990 Japan ..... 68/20

*Primary Examiner*—Frankie L. Stinson
*Attorney, Agent, or Firm*—Pearne, Gordon, McCoy & Granger

[57] ABSTRACT

A procedure that is applied for cleaning and removing lint from the drying air condenser for laundered clothes in a combined washer and dryer machine, a procedure suitable for obtaining said cleaning by washing the internal walls of said condenser with water taken from inside the basin during one or more phases of a washing cycle.

4 Claims, 2 Drawing Sheets

PROCESS FOR THE CLEANING OF A DRYING CONDENSER IN CLOTHES DRYER

The present invention concerns a process for the cleaning of the drying condenser for a combined machine for washing and drying clothing, process accomplished with simple devices easily assembled on this type of machine.

Combined machines for washing and drying clothes are available which essentially comprise an external metallic chassis, a basin containing a rotating basket for containing the clothes to be washed and dryed and conduit for the circulation of air for drying the clothes, connected to the basin and with at least one ventilator and an electric heating element, required for heating the air.

In this way, such machines are able to carry out in succession the washing of the clothes, with the introduction of the washing liquid in the basin and execution of the traditional wash and rinse cycles of the clothes, with final discharge of the washing liquid from the basin at the end of the washing cycles, as well as the drying of the clothes by means of closed cycle circulation in said conduit of air produced by the ventilator and heated by the heating element. In particular, in existing combined machines for washing and drying clothes the circulation conduit for the hot air consists generally in a plurality of performed component parts, which are connected amongst each other and with said ventilator and heating element as well as applied to the exterior of the basin, so that one extremity is arranged in correspondence of the flexible bellow for connection between the corresponding frontal openings of the chassis and the basin and that the other extremity is connected directly to the basin.

Also known are clothes drying machines in which the conduit for the circulation of drying air is formed by parts fixed against the internal walls of the chassis and connected amongst each other by means of flexible joints, for example according to the Italian patent (dom.) n. 34075-B/90

These machines present the inconvenience that during the drying phase a part of the lint that is removed from the clothing is transported by the flux of air and is deposited on the internal walls of the condenser, causing with time its clogging and hence a loss of overall drying efficiency.

To avoid this inconvenience a specific intervention is necessary normally carried out by the technical assistance service.

It would therefore be desirable, and it is the purpose of this invention, to arrange a drying process that resolves the cited inconvenience and which assures a satisfactory and reliable operation for all functional conditions of these machines.

This and other objectives are obtained by means of a process that includes the washing of the condenser during a wash or rinse phase or during one or more phases of discharge of the basin's water accomplished using the described characteristics with particular reference to the enclosed claims.

BRIEF DESCRIPTION OF THE DRAWINGS

The finding will be better understood from the following description, as a non limiting example and with reference to the enclosed figures where:

The FIG. 1 schematically shows a traditional combined machine for the washing and drying of clothing, in lateral view.

Figure 2:
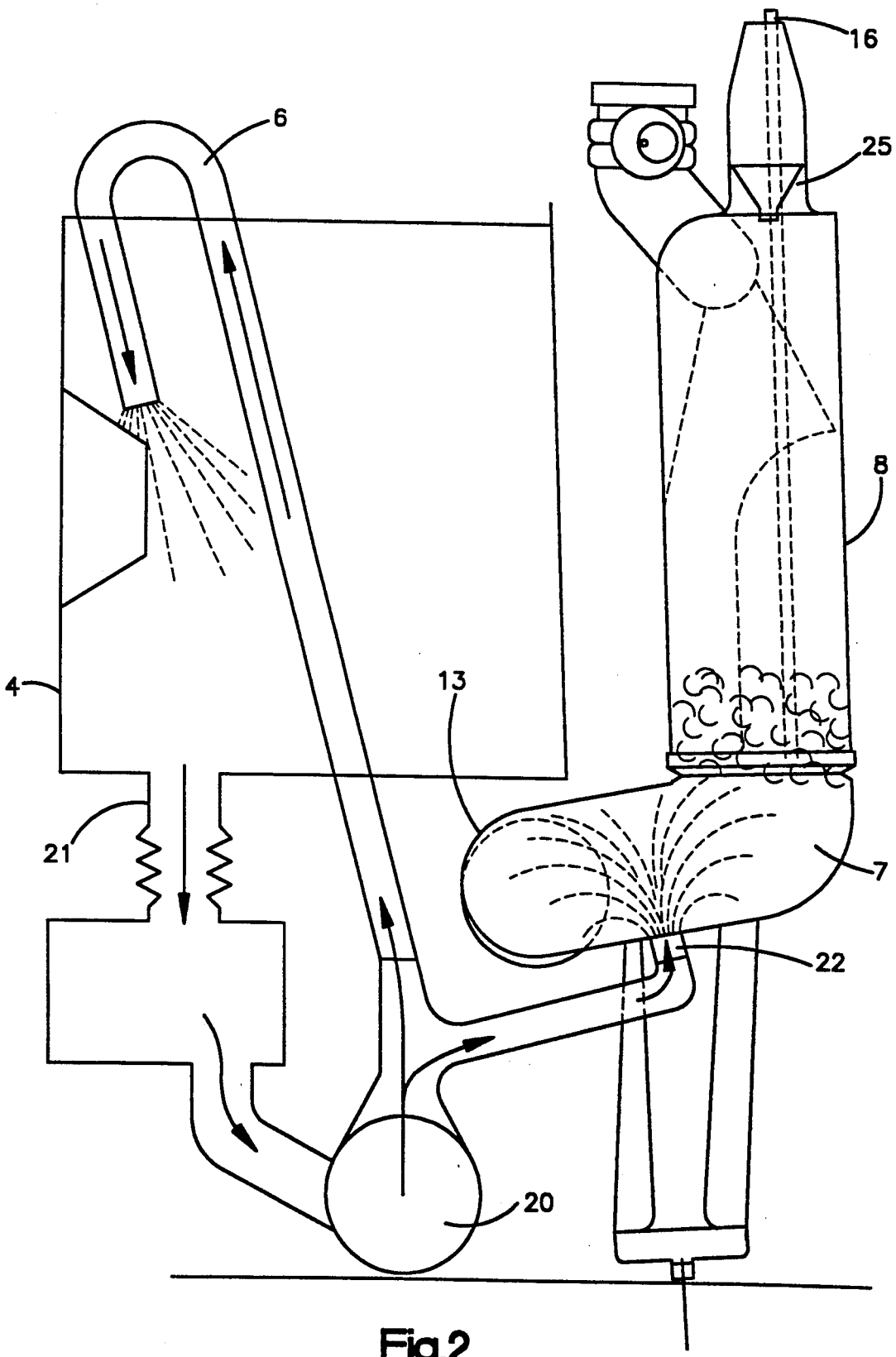

The FIG. 2 schematically shows a combined machine for washing and drying of clothes, in which the cleaning water occurs through recirculation.

DETAILED DESCRIPTION OF THE PREFERRED EMBODIMENT

Figure 1:
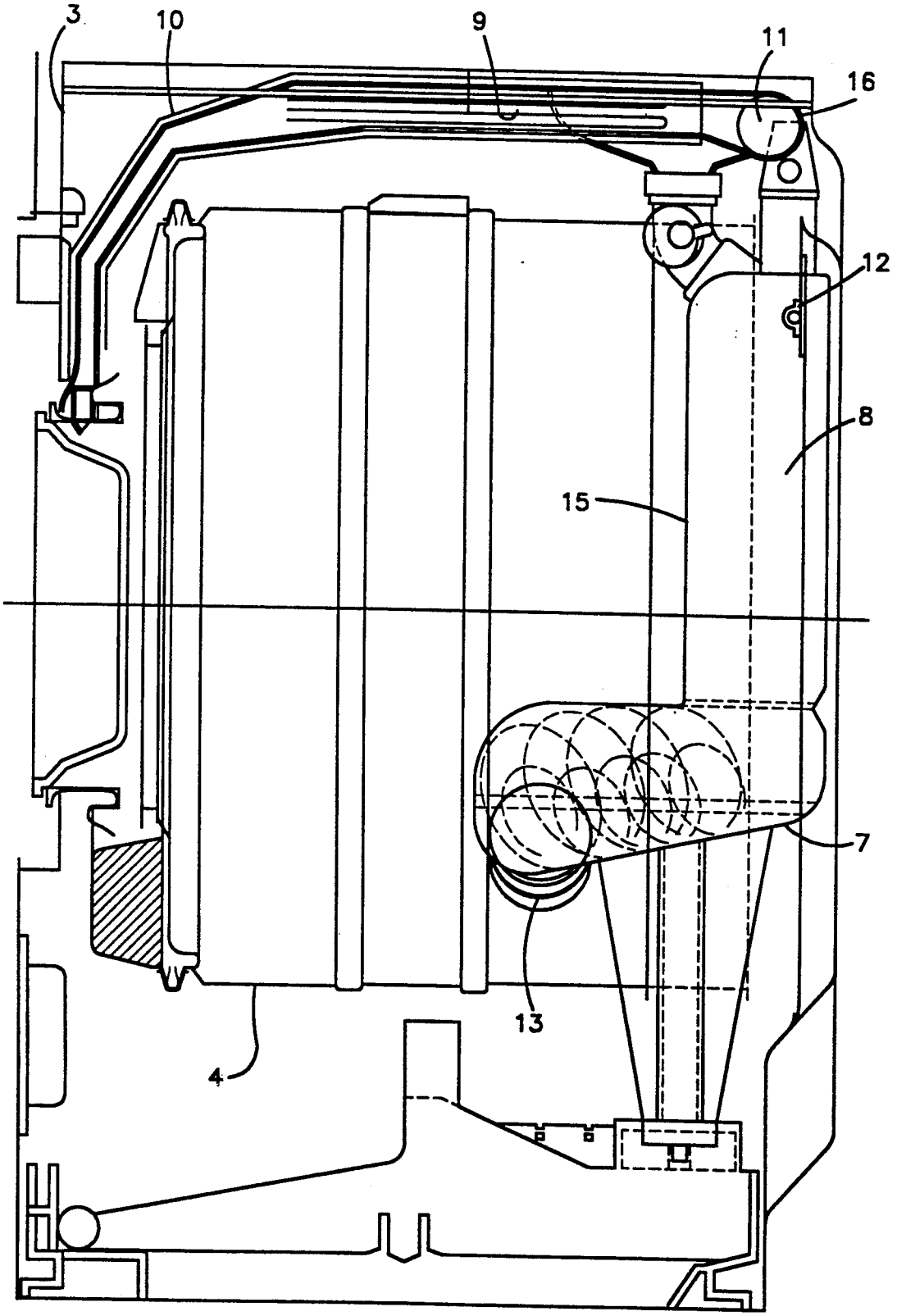

With reference to FIG. 1. a combined machine for the washing and drying of clothing is shown schematically, essentially comprising a metallic chassis 3, a metallic basin 4 and supported within such a chassis in a traditional fashion, a rotating basket 5 (not shown) arranged within the basin 4 and operational in rotation by an electric motor (not shown) with diverse rotation speeds during the course of the washing and drying cycles of the clothing, also including a conduit 10 for circulation of the hot air for drying the clothing, consisting in a plurality of performed component parts connected to each other and to said basin, for determining the gradual drying of the clothes contained in the basket through the closed cycle circulation of hot air and a condenser 15.

In the example represented in FIG. 1 this condenser 15 essentially consists in the reciprocal joining of a first lower part 7 appropriately shaped, in a second part 8 approximately square in shape where the condensation phase of the drying air is substantially carried out.

A conduit is connected in the top to said part 8 which is suitable to contain at least one traditional electric heating element 9 of the armoured type, required to heat the circulating drying air through said condenser, and by a third part shaped like a circular shell suited to contain at least one traditional type ventilator 11, required to produce the flux of air for drying through said conduit by means of the spraying of water against the flow relative to the direction of circulation of the water vapor. According to the innovative characteristic of the present invention, the process consists in performing a periodic "washing" of the inner wall of the inferior part 7, particularly in the lower region where the lint deposits are greater, activating the ventilator 11 when water is present in the basin, preferably during rinsing and discharge.

Operating said ventilator causes, due to its non negligible prevalence, a suction of water through the lower intake opening 13 between the condenser and the basin, because said opening is located at a lower level relative to the water's level during said phases.

In this way, as can be easily verified in practice, a suction of relatively clean water is caused that rises up to a certain level in said lower part 7.

Appropriately dimensioning said opening 13 and the curvature of part 7 the effect can easily obtained that the water, drawn by the basin by the suction effect of the ventilator, reaches a level within said lower part 7, which causes the washing of lint in this zone, which can in this way be easily predetermined. In this way said water causes the cleaning action of the walls and therefore the removed lint is again pulled inside the basin with the cleaning water when the ventilator's functioning is stopped, and therefore definitively discharged externally during the subsequent discharge phase.

The operation of this process will now be clear: every time the water inside the basin reaches a predetermined level during the established phase (which can either be a water filling phase signalled by an appropriate pressure switch, or for example, a discharge phase), a command circuit for the ventilator is set up which activates it for a predetermined period or for a specific operating phase of the machine so as to cause the desired effect of aspiration of water inside the lower part 7 and the consequent washing by aeration.

An advantageous variation of the aforementioned process for washing the condenser can be applied to the type of machine for the combined washing and drying of clothing in which the water that is used for washing the clothing is inhaled from the bottom of the basin and made to recirculate through a suitable pump and returned to the basin, preferably from above, as shown in FIG. 2.

With reference to said figure, we can see the recirculating pump 20, the aspiration channel 21 for the water from the bottom of the basin 4, and an additional inlet channel, preferably of smaller dimensions 22, which runs inside the lower part 7.

The pump 20 recirculates the water again inside the basin 4 through an additional conduit 6.

The washing process of the lower part 7 of the condenser in machines of this type is automatically achieved during the recirculation phase, in which through said inlet channel 22 the pump sends a water jet of suitable speed and capacity against at least one internal wall of said lower part 7 so that said water jet while splashing around internally causes the desired washing operation of said lower part 7.

The water used for this operation is then normally pulled by gravity in the basin where it can continue to be used for recirculation.

The processes just described clearly solve the problem of removal of lint from the condenser.

Nevertheless another difficulty can occur. In fact, the air's turbulence in the upper part 8 of the condenser can, over time, cause the deposition of significant quantities of lint residue around the entrance 16 of the water to the condenser itself, as shown in FIG. 2. All this can cause the clogging of the vicinity of said entrance causing irregular diffusion and hence a reduction of drying performance.

To eliminate even this inconvenience, a device is provided shown in the same FIG. 2, where the application of a diaphragm 25 is shown which can have different shapes, preferably conical or funnel shaped.

Such a diaphragm 25 is applied below the entrance 16 of the water of condensation in the condenser to limit or block the air and water vortexes which eventually contain the lint.

This particular funnel shape infact allow the water of condensation to run off regularly towards the bottom, while it prevents the entrance of the above described vortexes in the vicinity of the entrance 16 of the jet of condensed water.

It is evident that the device 25 just described and shown in FIG. 2 can be applied independently from the processes for washing the condenser described above.

An additional advantage of this invention consists in the fact that, since this process can be accomplished with simple modifications of existing washer/dryer machines, it is also possible to rapidly transform such types of machines by adding the possibility to carry out the process, using the same basin-basket assembly, the same conduit, the heating elements, the ventilator, the condenser and the other fundamental components of the machine.

We claim:

1. A process for cleaning internal walls of a drying air condenser in a combined machine for washing and drying clothing in a basin by condensation comprising the steps of:

heating the drying air by means of a heating element (9);

forcing circulation of said air by means of a ventilator (11);

condensing humidity contained in said air with a jet of fresh water entering said circulating air, said condensation occurring in a suitable condenser (7,8);

discharging the condensed humidity outside the machine; and cleaning said condenser, in particular its lower portion (7), by means of forced circulation of a portion of washing or discharge liquid inside said condenser.

2. A process for washing the internal walls of a condenser according to claim 1, in which said condenser is in communication with said basin through an opening (13) in the lower part of the condenser, the step of cleaning the condenser being characterized by the fact that during at least one period in which the level of water in the basin surpasses the level of said opening, suction of the circulating air used for drying is activated by said ventilator (11) to raise water from the basin into said condenser.

3. A process for washing the internal walls of a condenser according to claim 1, further wherein the machine comprises a recirculating pump (20) for suction of washing liquid from the bottom of the basin (4) and the subsequent admission of the liquid into the basin through a corresponding conduit of recirculation (6), characterized by the fact that said recirculating pump (20) through an additional conduit (22) sends a jet of washing liquid inside the condenser.

4. A process for cleaning according to claim 3, characterized by the fact that said jet originating from said second conduit (22) enters inside said condenser with a speed capable of reaching and hitting a condenser wall opposite the conduit entrance and then a condenser wall adjacent the conduit entrance so as to cause a continuous bouncing of said jet substantially in every direction so as to wet and therefore wash the internal surface of said condenser, in particular in the vicinity of its lower part (7).

* * * * *